US005636798A

United States Patent [19]

Buschor

[11] Patent Number: 5,636,798

[45] Date of Patent: Jun. 10, 1997

[54] ELECTROSTATIC SPRAY DEVICE

[75] Inventor: Karl Buschor, St. Gallen, Switzerland

[73] Assignee: Gema Volstatic AG, St. Gallen, Switzerland

[21] Appl. No.: 451,596

[22] Filed: May 26, 1995

[30] Foreign Application Priority Data

May 26, 1994 [DE] Germany ..... 44 18 288.0

[51] Int. Cl.[6] ..... B05B 5/053; B05B 15/08

[52] U.S. Cl. ..... 239/696; 239/706; 239/587.1; 239/591

[58] Field of Search ..... 239/690, 708, 239/290, 296, DIG. 14, 587.1, 694, 706, 3, 597–599; 118/697, 702, 315, 314; 901/42, 43

[56] References Cited

U.S. PATENT DOCUMENTS

| | | | |
|---|---|---|---|
| 3,570,725 | 3/1971 | Baker | 118/315 X |
| 4,228,958 | 10/1980 | Perry . | |
| 4,386,739 | 6/1983 | Kwok | 239/296 |
| 4,706,889 | 11/1987 | Hofmann | 239/566 X |
| 4,762,013 | 8/1988 | Peter et al. | 118/315 X |
| 4,779,804 | 10/1988 | Baba et al. | 901/43 X |
| 4,798,341 | 1/1989 | Gimple . | |
| 4,909,180 | 3/1990 | Oishi et al. | 118/315 X |
| 4,931,322 | 6/1990 | Yamamoto et al. | 118/315 X |
| 4,993,645 | 2/1991 | Buschor . | |
| 5,022,590 | 6/1991 | Buscher | 239/708 |
| 5,071,074 | 12/1991 | Lind . | |
| 5,320,283 | 6/1994 | Hollstein et al. . | |
| 5,358,568 | 10/1994 | Okano et al. | 901/43 X |

FOREIGN PATENT DOCUMENTS 2553006 4/1985 France .

*Primary Examiner*—Kevin Weldon
*Attorney, Agent, or Firm*—Schwartz & Weinrieb

[57] ABSTRACT

Electrostatic spray appliance for coating material for the spray-coating of articles comprises a single carrier (4) which carries a plurality of gun barrels (6, 8), so that the carrier (4), together with the gun barrels, forms spray guns. The gun barrels (6, 8) are releasably fastened to the carrier (4). The supply lines (54, 56, 58, 60, 62, 64, 78) are combined to form a line bundle and are led through a movable robot arm (68) in the longitudinal direction of the arm on the side of the carrier (4) facing away from the gun barrels (6, 8). The spray nozzles (12) are preferably slit nozzles having slits arranged obliquely relative to their theoretical connecting line.

17 Claims, 2 Drawing Sheets

ELECTROSTATIC SPRAY DEVICE

FIELD OF THE INVENTION

The invention relates to an electrostatic spray device for coating material used to spray-coat objects.

BACKGROUND OF THE INVENTION

As the coating material, powdered material is preferably used, but liquid coating material can also be used. In electrostatic spray-coating, the coating material is electrostatically charged by means of high-voltage electrodes, in a known manner, either directly before or after being atomized. The high-voltage electrodes are connected to a high voltage generator, which generates a high voltage, for example of 100 kV. However, other voltages in the range from 30 to 140 kV are also known.

Comparable electrostatic spray devices are known, for example, from U.S. Pat. No. 4,993,645 and U.S. Pat. No. 5,022,590. They show a spray gun with a gun barrel and a holder, which latter can be a handle or an element which can be attached to a holder device, such as a robot, for example. The gun barrel and the carrier or holder are connected with each other so that they can be released, and are structured in such a way that the same gun barrel can be optionally attached to a gun handle or a carrier or holder device which can be attached to a robot. The gun barrel and the carrier are connected with each other so that they can be released, by means of a plug-in connection, and they are structured in such a way that when they are plugged together, fluid lines and electrical lines which pass through them are also connected with each other at the same time.

Furthermore, it is known from the state of the art to attach several electrostatic spray-coating guns to a lifting device by means of their carriers, and to coat an object with them at the same time. The use of several spray guns instead of a single spray gun makes it possible to spray a thicker layer of coating material onto an object, while it is moved past the spray guns in a single pass, than would be possible when using only a single spray gun. Particularly when spray-coating objects with powder, it is not possible to spray any desired amount of powder onto the object per time unit, because the powder velocity required for a higher amount of powder and a correspondingly large number of powder particles which strike the object at the same time have the result that many powder particles bounce off the object again instead of adhering to it. Furthermore, the quality of the coating to be produced can be impaired in this connection.

SUMMARY OF THE INVENTION

The invention is intended to accomplish the task of coating an object with fluid particles using several spray nozzles at the same time, without fluid lines and/or electrical lines hindering the movements of the spray nozzles or touching the object. At the same time, a high degree of effectiveness that is, sufficiently thick material layers with little energy, little or no loss of coating material, a good coating quality and a quick paint change that is coating material change are to be achieved.

The foregoing task is accomplished, according to the invention, by the srtructural system more fully set forth and described hereinafter.

BRIEF DESCRIPTION OF THE DRAWINGS

Various other objects, features, and attendant advantages of the invention will be more fully set forth hereinafter and described with reference to the drawings, on the basis of preferred embodiments as examples in which like references characters designate like or corresponding parts throughout the several views and wherein.

DETAILED DESCRIPTION OF THE ILLUSTRATED EMBODIMENTS

Figure 1:
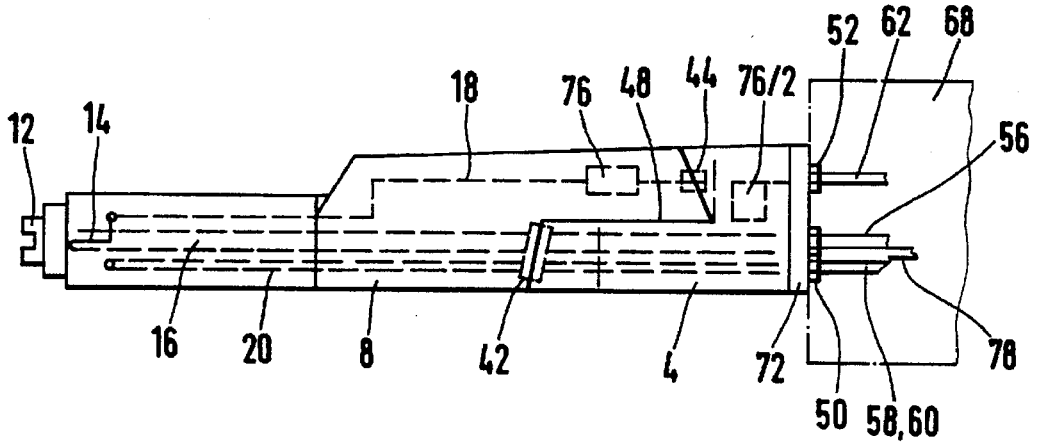
FIG. 1 is schematically, a side view of an electrostatic spray device according to the invention for spraying coating materials, particularly powdered coating materials, for spray-coating objects.
Figure 2:
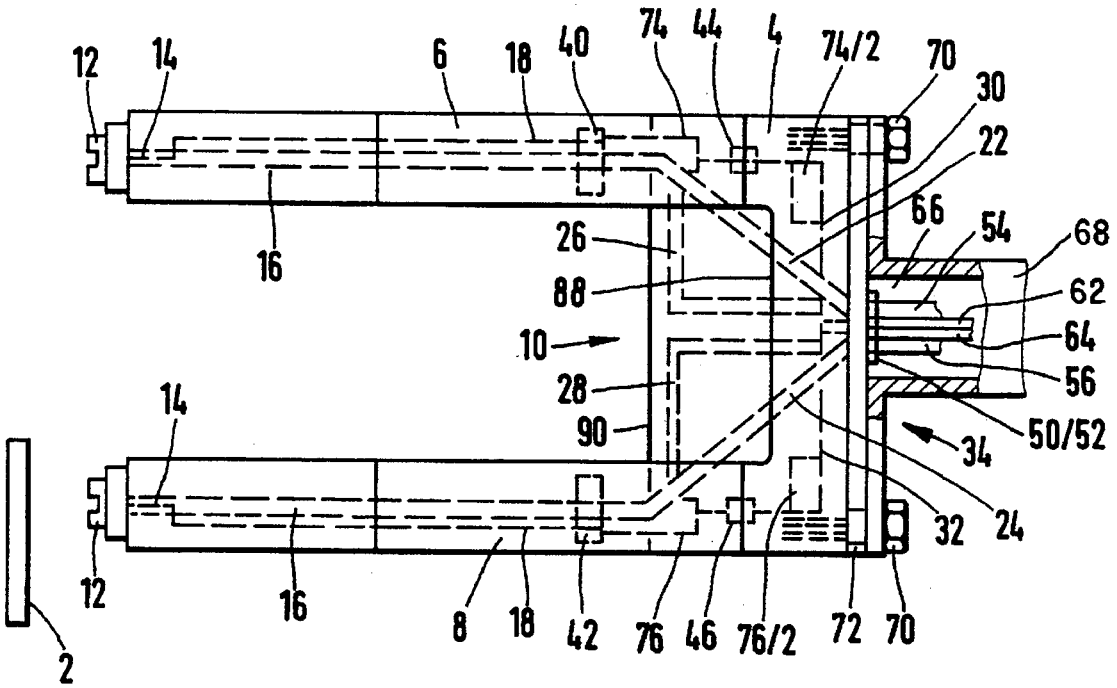
FIG. 2 is a top view of the spray device of FIG. 1.

The electrostatic spray device according to the invention as shown in the drawings is provided for spray-coating objects 2 with powdered coating material and essentially consists of a carrier 4 and at least two gun barrels 6 and 8. The number of gun barrels 6 and 8 can be as large as desired, for example sixteen gun barrels can be provided. The gun barrels 6 and 8 are preferably structured in an identical manner. All the gun barrels 6 and 8 are arranged on a first carrier side 10 and are attached to the carrier 4 at their rear end segments, so that they can be released, for example by means of a plug-in connection as such is known from U.S. Pat. No. 4,993,645 and U.S. Pat. No. 5,022,590. The rear end segments of the gun barrels 6 and 8 and the first carrier side 10 which lies opposite them can be structured in a stepped manner, and in such a way as is shown in the drawings and described in the aforementioned patents. In this way, the gun barrels 6 and 8 can be attached to the single carrier 4 quickly and without wiggling, without the necessity of any large-volume elements. The gun barrels 6 and 8 are each provided with at least one spray nozzle 12 and one high-voltage electrode 14 at their front end segments. An internal fluid channel 16 for supplying coating material to the spray nozzle 12 and an internal electrical switching element 18 for power supply to the high-voltage electrode 14 extend through each of the gun barrels 6 and 8 in the longitudinal direction of the gun barrels. Furthermore, a second internal fluid channel 20 extends through the gun barrels 6 and 8 in the longitudinal direction, by means of which compressed air is supplied to the electrodes 14, which air surrounds the electrodes and thereby keeps them free of coating material, as well as transfers electrically charged air particles from the electrode to the coating material so that the coating material becomes electrostatically charged and is attracted by the object 2 to be coated, which is connected to ground potential or another electrical potential that is different from the electrical potential of the high-voltage electrode 14. First connecting fluid channels 22 and 24 for supplying the first internal fluid channel 16 of the gun barrels 6 and 8 with coating material pass through the carrier 4. In the present case, the coating material is powder and these first internal fluid channels 16 can therefore also be referred to as powder channels. Furthermore, second connecting channels 26 and 28 pass through the carrier 4 so as to supply the second internal fluid channels 20 with compressed air for the high-voltage electrodes 14, so that these second internal fluid channels 20 can also be referred to as compressed air channels. In addition, electrical connecting switching elements 30 and 32 extend through the carrier 4 so as to supply electrical energy to the electrical switching elements 18 housed in the gun barrels 6 and 8. These connecting fluid channels 22, 24, 26 and 28 as well as the electrical connecting switching elements 30 and 32 each extend through the carrier 4, from the first carrier side 10 to a second carrier side 34. The connecting fluid channels 22, 24, 26, 28 and the connecting switching elements 30, 32 are connected with the internal fluid channels 16 and 20 as well as the internal switching elements 18 of the gun barrels 6 and 8 on the first carrier side 10 by means of first connection means 40, 42, 44 and 46, forming a mechanical and functional connection that can be released, and they are automatically connected when the gun barrels 6 and 8 are plugged onto the carrier 4 by means of plug-in connections 48 which extend longitudinally. The one set of connecting fluid channels 22, 24 are each connected with at least one coating material fluid line 54, 56, and the other set of connecting fluid lines 26, 28 are each connected with at least one compressed air line 58, 60 per gun barrel 6, 8 on the second carrier side 34, by means of first quickconnect means 50, such as plug-in connections or screw-on connections or plug-screw connections, forming a mechanical and functional connection that can be released. The connecting switching elements 30 and 32 of the carrier 4 are connected with at least one electrical energy supply line 62, 64 per gun barrel 6, 8 on the second carrier side 34, by means of second quick-connect means 52, such as plug-in connections or screw-on connections or plug-screw connections, forming a mechanical and functional connection that can be released.

All external fluid lines 54, 56, 58, 60 and external electrical energy supply lines 62, 64 extend in the longitudinal direction of the gun barrels 6 and 8, but in opposite directions, away from the carrier 4, and are brought together in a line bundle, at least at their end segments that are connected to the carrier 4, by being passed through a channel 66 of the robot arm 68 in the longitudinal direction of the arm. The channel 66 extends through the robot arm 68 in the longitudinal direction of the arm, to the carrier 4. The carrier 4 is attached to the robot arm 68 by means of quick-release attachment means 70, so that it can be released. On the carrier 4, on its second carrier side 34, an electrically conductive metal plate 72 is attached, to which elements of the carrier 4, the gun barrels 6 and 8, and the robot arm 68, which must be grounded, are connected. The metal plate 72 is arranged on the carrier 4 in such a way that it automatically rests against the electrically conductive robot arm 68 and forms an electrical connection with it when the carrier 4 is attached to the robot arm 68.

In the preferred embodiment of the spray device, the internal electrical switching element 18 in each gun barrel 6, 8 contains a high voltage generator 74, 76, which converts a low voltage supplied by means of the external energy supply line 62, 64 into the high voltage required for the high-voltage electrodes 14. In accordance with another embodiment, the high voltage generators 74, 76 are not located in the gun barrels 6 and 8, but rather in the carrier 4, as is schematically shown by the reference numbers 74/2 and 76/2. In accordance with another different embodiment, the high voltage generators 74, 76 can be replaced with external high voltage generators, which are arranged outside of the gun barrels 6, 8 and outside of the carrier 4, so that the high voltage must be passed to the high-voltage electrodes 14 by means of the external electrical energy supply lines 62 and 64. One of the external fluid lines, for example the fluid line 78, can be used to supply flushing fluid to flush the channels 16 which serve to supply coating material.

The robot arm 68 moves the carrier 4 and the gun barrels 6 and 8 at attached thereto relative to the object 2 to be coated. For example, the object 2 can be moved horizontally, and the carrier 4 and the gun barrels 6 and 8 can be moved vertically. Furthermore, movement of the carrier 4 and the gun barrels 6, 8 in the horizontal direction relative to the object 2 to be coated is also of course posseble by means of the robot arm 68.

Figure 3:
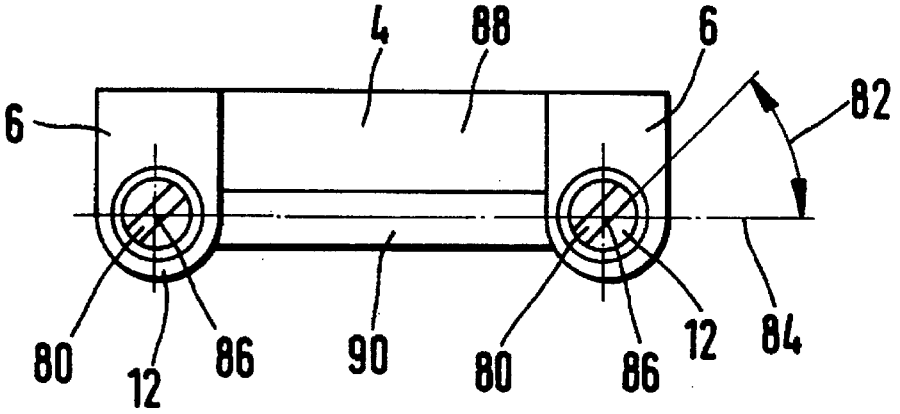
FIG. 3 is a front elevational view of the spray device according to FIGS. 1 and 2.

In accordance with the special embodiment shown, the spray nozzles 12 are structured as slit nozzles and their slits 80 run parallel to one another, and at the same time at angles 82 significantly different from zero degrees and 90 degrees, for example at an angle of 45 degrees with respect to a theoretical line 84 on which the axial nozzle center points 86 are arranged, as seen in the front elevational view shown in FIG. 3. With such an embodiment with several gun barrels 6 and 8 and nozzle slits 80 arranged at an inclined angle with respect to the arrangement line 84, not only is it possible to apply a large amount of coating material onto the object 2 to be coated, in a single spray process, but also a uniformly thick coating material layer is obtained on the object 2, thus resulting in good coating quality.

The carrier 4 has a set-back upper face surface 88 and a forward lower face surface 90 on its first carrier side 10.

In the embodiment shown, a separate feed of coating material and high voltage is provided for each gun barrel 6 and 8. In a modified embodiment, a central coating material feed line and/or a central electrical energy supply line can be connected to the carrier 4 for all the gun barrels, as an external line, in which case corresponding distributor channels are formed in the carrier 4, which lead to the individual or separate gun barrels 6 and 8.

In accordance with another modified embodiment, the holder device 68 can be a handle instead of a robot arm, so that the carrier 4 and the gun barrels 6 and 8 can be used by hand.

By passing all the external lines 54, 56, 58, 60, 62, 64, 78 through the robot arm 68 in the longitudinal direction of the arm, the situation is avoided wherein these lines could touch the object 2 to be coated and damage the paint layer thereon or stick to it or other objects. The robot arm 68 can be moved through openings of the object 2 to be coated, together with the carrier 4 and the gun barrels 6 and 8, without any such disadvantages. In this way, even the back or the inside of the object can be coated, for example car doors or bodies or housings. Because all the external lines 54, 56, 58, 60, 62, 64, 78 lead away from the carrier 4, in the same direction and are brought together as a line bundle, the lines have little resistance to movements of the carrier 4 relative to the object 2 to be coated, in comparison with lines that project away from the carrier 4 in different directions or different size arcs. The line ends, which are located at a distance from the carrier 4, are fixed in place in the robot or in a wiring cabinet or other control system. Because of this disruption-free mobility of the carrier 4 and the gun barrels 6 and 8, sudden movements are avoided. Avoiding sudden movements is important to achieve a good spray profile and thus a good coating quality.

Figure 4:
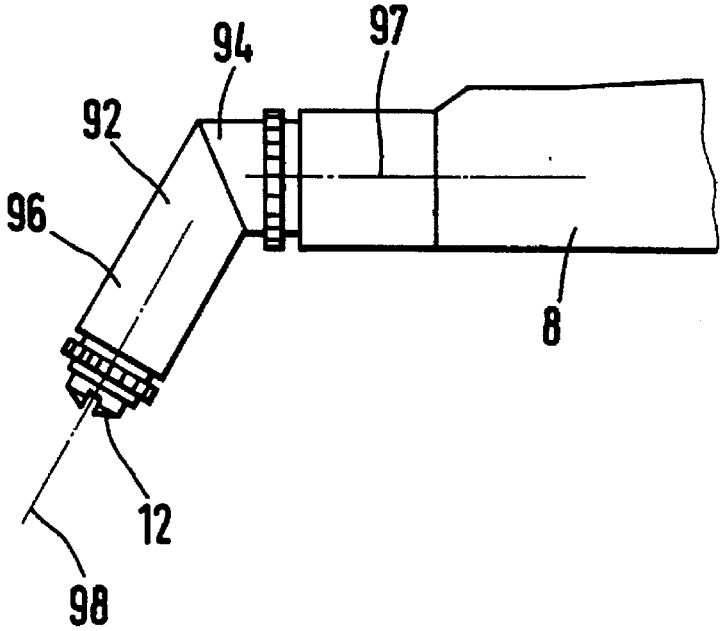
FIG. 4 is a side view similar to, FIG. 1, of another embodiment according to the invention.

In the embodiment according to FIG. 4, the spray nozzle 12 is attached to the front end of the gun barrel 8 by means of a bracket 92. In the same manner, a spray nozzle 12 is attached to the other gun barrel 6, not shown, by means of a bracket 92. The one shank 94 of the bracket is arranged in the longitudinal direction of the related gun barrel 6 or 8, and the other shank 96 is arranged in the spray direction of the related spray nozzle 12. The bracket 92 can be rotated around the longitudinal axis 97 of the gun barrel, relative to the related gun barrel 6 or 8. The spray nozzle 12 can be rotated around its spray axis or longitudinal axis 98 relative to the bracket 92. In this way, the spray can be aimed in different directions and can be adjusted to different flat spray angles 82 as a flat spray. In this way, large surfaces, corners, angles and covered surfaces of an object, for example, surfaces located behind a wall, can be coated quickly and well with this embodiment.

In all the embodiments of the invention, several gun barrels 6 and 8 are attached to the carrier 4, so that they can be released, and they can thereby form a number of spray guns, together with the carrier 4, that corresponds to the number of gun barrels 6 and 8, which can be operated independently or dependent on one another.

Obviously, many modifications and variations of the present invention are possible in light of the above teachings. It is therefore to be understood that within the scope of the appended. claims, the present invention may be practiced otherwise than as specifically described herein.

I claim:

1. An electrostatic spray device for spray-coating an article with coating material, comprising:

a machine arm having a first hollow interior space defined therein, and being movable with respect to an article to be coated;

a carrier releasably mounted upon said machine arm, and having a second hollow interior space defined therein;

a plurality of gun barrels, releasably mounted upon said carrier, wherein each gun barrel has a third hollow interior space respectively defined therein, and forming with said carrier a respective plurality of spray guns;

a plurality of electrodes respectively disposed within said plurality of gun barrels;

a plurality of coating material supply lines for respectively supplying coating material to each one of said plurality of gun barrels;

a plurality of compressed air supply lines for respectively supplying compressed air to each one of said plurality of gun barrels; and a plurality of electrical power supply lines for respectively supplying electrical power to said plurality of electrodes disposed within said gun barrels;

said plurality of coating material supply lines, said plurality of compressed air supply lines, and said plurality of electrical power supply lines all being disposed together as a bundle of supply lines within said first hollow interior space of said machine arm, divergently disposed within said second hollow interior space of said carrier so as to be respectively routed toward said plurality of gun barrels, and being respectively disposed within said third hollow interior spaces respectively defined within said gun barrels, whereby said plurality of coating material supply lines said plurality of compressed air supply lines, and said plurality of electrical power supply lines are all housed internally within said gun barrels, said carrier, and said machine arm so as not to hinder movement of said machine arm and said spray guns with respect to said article to be coated, or to adversely affect said coating material sprayed upon said coated article as a result of plurality of coating material supply lines, said plurality of compressed air supply lines, and said plurality of electrical power supply lines contacting said coated article.

2. The device as set forth in claim 1, further comprising:

a plurality of spray nozzles respectively disposed upon forward end portions of said plurality of gun barrels for discharging said coating material onto said article to be coated.

3. The device as set forth in claim 2, wherein:

said plurality of gun barrels are disposed within a common plane when mounted upon said carrier.

4. The device as set forth in claims 3, wherein:

said spray nozzles comprise slit nozzles having slit apertures.

5. The device as set forth in claim 4, wherein:

said slit apertures of said slit nozzles are disposed at a predetermined angle with respect to said plane within which said gun barrels are disposed.

6. The device as set forth in claim 5, wherein:

said predetermined angle is 45°.

7. The device as set forth in claim 2, further comprising:

angular bracket means for mounting each one of said plurality of spray nozzles upon a respective one of said forward end portions of said plurality of gun barrels, each one of said angular bracket means comprising a first bracket portion coaxial with said respective one of said forward end portion of said gun barrel upon which said first bracket portion is mounted, and a second bracket portion having a longitudinal axis which is disposed at a predetermined angle with respect to, the longitudinal axis of said first bracket portion and said forward portion of said gun barrel.

8. The device as set forth in claim 1, wherein:

each one of said plurality of coating material supply lines comprises a plurality of coating material supply line sections respectively disposed within said machine arm, said carrier, and a respective one of said plurality of gun barrels;

each one of said plurality of compressed air supply lines comprises a plurality of compressed air supply line sections spectively disposed within said machine arm, said carrier, and a respective one of said plurality of gun barrels;

each one of said plurality of electrical power supply lines comprises a plurality of electrical power supply line sections respectively disposed within said machine arm, said carrier, and a respective one of said plurality of gun barrels; and disconnectible connector means interposed between said plurality of coating material supply line sections, said plurality of compressed air supply line sections, and said plurality of electrical power supply line sections for permitting substantially quick and easy connection and disconnection of said plurality of coating material supply line sections, said plurality of compressed air supply line sections, and said plurality of electrical power supply line sections.

9. The device as set forth in claim 8, wherein:

said disconnectible connector means comprise plug-in type connectors.

10. The device as set forth in claim 9, further comprising:

disconnectible connector means interposed between said carrier and said plurality of gun barrels for permitting substantially quick and easy connection and disconnection of said plurality of gun barrels with respect to said carrier.

11. The device as set forth in claim 10, wherein:

said disconnectible connector means interposed between said carrier and said plurality of gun barrels comprise plug-in type connectors whereby said plug-in type connectors interposed between said plurality of coating material supply line sections, said plurality of compressed air supply line sections, and said plurality of electrical power supply line sections may be connected together at the same time that said plug-in type connectors interposed between said carrier and said plurality of gun barrels are connected together.

12. The device as set forth in claim 1, wherein:

said machine arm comprises a robot arm.

13. The device as set forth in claim 1, further comprising:

voltage generator means disposed within each one of said plurality of gun barrels for supplying electrical power to a respective one of said electrodes respectively disposed within a particular one of said gun barrels.

14. The device as set forth in claim 1, further comprising:

a plurality of voltage generator means disposed within said carrier for providing electrical power to said plurality of electrodes respectively disposed within said plurality of gun barrels.

15. The device as set forth in claim 1 wherein:

said machine arm has a longitudinal axis; and said plurality of gun barrels have longitudinal axes which are disposed parallel to said longitudinal axis of said machine arm.

16. The device as set forth in claim 7, wherein:

said first bracket portion is rotatably mounted upon said forward end portion of said gun barrel such that said first bracket portion is rotatably adjustable to different angular positions with respect to said gun barrel; and said spray nozzle is rotatably mounted upon a forward end portion of said second bracket portion so as to be rotatably adjustable to different angular positions with respect to said second bracket portion, whereby the angular disposition of said spray nozzle with respect to said gun barrel is rotatably adjustable as a result of the rotatable adjustment of said first bracket portion with respect to said gun barrel and the rotatable adjustment of said spray nozzle with respect to said second bracket portion.

17. The device as set forth in claim 4, wherein:

said spray nozzles are rotatably mounted upon said gun barrels such that said slit apertures of said slit nozzles are rotatably adjustable to different angular positions.

* * * * *